US005619807A

United States Patent [19]

Conrad

[11] Patent Number: 5,619,807

[45] Date of Patent: Apr. 15, 1997

[54] METHOD AND APPARATUS FOR PROCESSING A WEB OF MATERIAL

[75] Inventor: Hans-Rolf Conrad, Dormagen, Germany

[73] Assignee: Voith Sulzer Finishing GmbH, Krefeld, Germany

[21] Appl. No.: 413,683

[22] Filed: Mar. 30, 1995

[30] Foreign Application Priority Data

Apr. 13, 1994 [DE] Germany ..... 44 12 624.7

[51] Int. Cl.[6] ..... F26B 3/00

[52] U.S. Cl. ..... 34/414; 34/446; 162/121; 162/122

[58] Field of Search ..... 34/446, 414, 411; 162/118, 121, 122, 283

[56] References Cited

U.S. PATENT DOCUMENTS

| | | | |
|---|---|---|---|
| 1,117,113 | 11/1914 | Wagg | 162/121 |
| 2,269,884 | 1/1942 | Stocker | 162/283 |
| 2,414,739 | 1/1947 | Heygel | 162/283 |
| 2,486,121 | 10/1949 | Corn | 162/283 |
| 2,861,504 | 11/1958 | Kane | 92/75 |
| 4,087,319 | 5/1978 | Linkletter | 162/283 |
| 4,343,095 | 8/1982 | Rosen et al. | 34/411 |
| 5,160,399 | 11/1992 | Ueda et al. | 34/446 |
| 5,212,877 | 5/1993 | Onur et al. | 34/446 |
| 5,319,863 | 6/1994 | Kotitschke et al. | 34/414 |
| 5,377,428 | 1/1995 | Clear | 34/446 |

FOREIGN PATENT DOCUMENTS

| | | |
|---|---|---|
| 0501035 | 9/1992 | European Pat. Off. . |
| 3601297 | 4/1988 | Germany . |

*Primary Examiner*—John T. Kwon
*Attorney, Agent, or Firm*—Darby & Darby

[57] ABSTRACT

A method and apparatus for processing a web of material, which is dispensed from a roll and fed through at least one roller gap of a roller-gap system which includes a processing station, an unrolling station on the input side of the processing station, and a roll magazine on the input side of the unrolling station which magazine includes at least one roll storage position. When rolls of web material are processed, the processing delay times lead to an uneven distribution of the temperature and/or moisture within the roll which in turn causes nonuniformity of the results in the processing station. The web of material still on the roll is exposed, prior to being unrolled, to a preselected atmospheric environment for a predetermined minimum length of time. Accordingly, the roll storage position is located in a chamber, the atmosphere of which can be controlled to a preset temperature and/or humidity level.

20 Claims, 1 Drawing Sheet

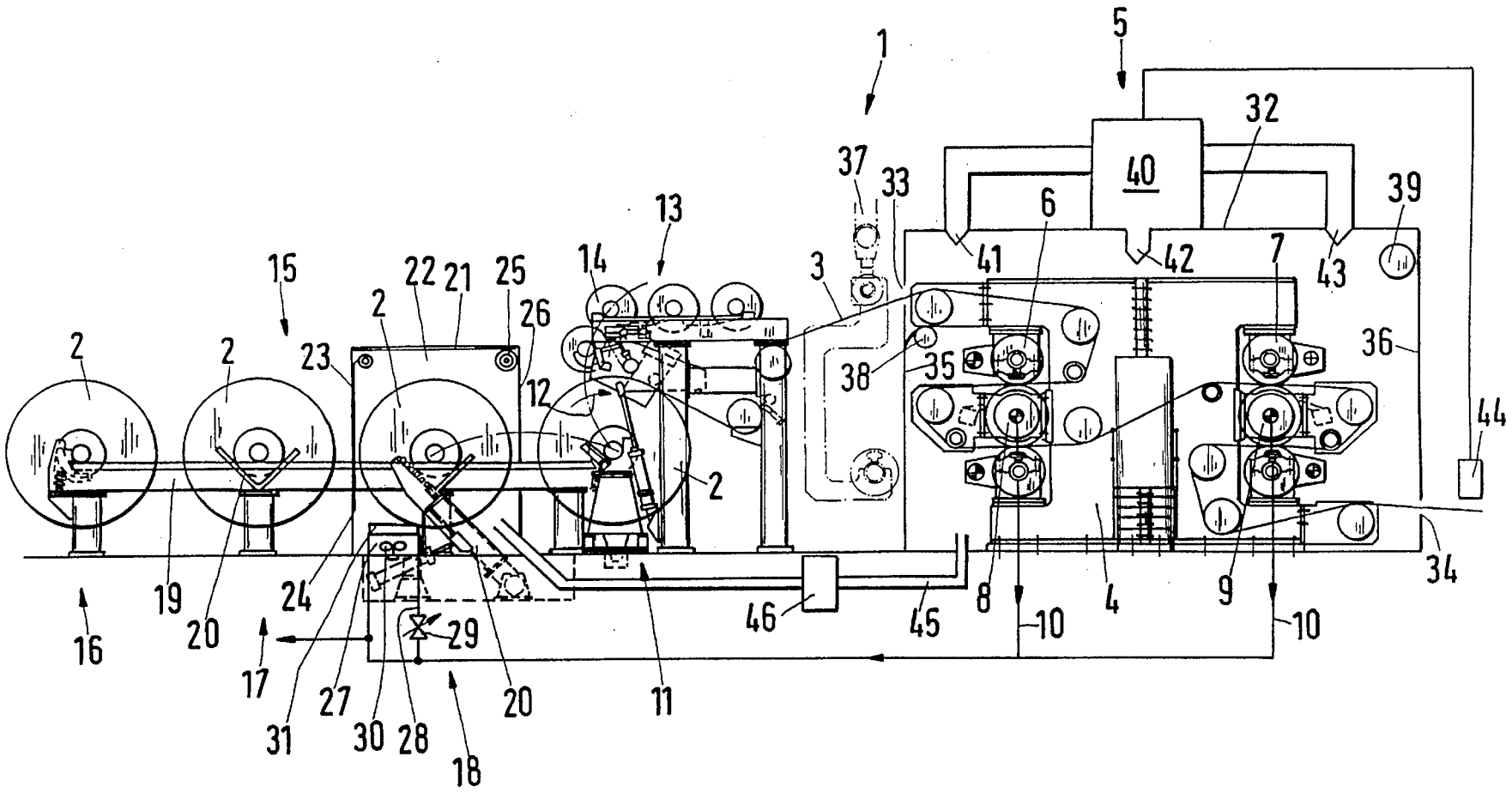
44
34
39
36
43
10
32
7
9
42
40
5
4
6
10
41
8
35
45
33
1
37
38
3
46
2
13
11
14
12
26
25
20
21
18
22
29
2
28
30
27
23
24
31
15
17
2
20
19
16
2

METHOD AND APPARATUS FOR PROCESSING A WEB OF MATERIAL

FIELD OF THE INVENTION

This invention relates generally to a procedure for processing a web of material dispensed from a roller and fed through at least one roller gap of a roller-gap system, and more particularly, to a system for processing a web of material wound on a roller which incorporates a storage position, a roll magazine, an unrolling station, and a processing station, respectively.

BACKGROUND OF THE INVENTION

A web of material, such as paper produced in a paper machine, is wound into large rolls having diameters and lengths of up to several meters, for example, 3 meters wide by 10 meters long. When wound, the paper has a temperature of between 40° C. (104° F.) and 70° C. (158° F.) and a particular moisture level. Prior to further processing, such as glaze finishing in an off-line calender which in this example serves as the processing station, the roll of paper normally cools off to ambient temperature, but not uniformly over the roll's entire cross section. Rather, the cooling-off process begins at the outer layers and end surfaces of the roll and gradually progresses to the inside. Thus, a temperature gradient is created in the roll which extends primarily in radial fashion from the inside to the outside and also contains components in the roll's axial direction.

The trend toward faster throughput of rolls in a paper mill prevents one from waiting until the temperature of the roll is perfectly uniform. Instead, after a relatively short period of time, the roll is moved to the next processing step, such as the aforementioned glaze finishing. At that point, the web of paper is fed under pressure through at least one roller gap. Typically, one of the rollers forming the roller gap is heated by a liquid positioned within the roller.

The temperature gradient across the roll's radius causes a continuous temperature change of the web as it is fed into the calender. As a result, the roll's temperature increases as the paper is unrolled. Since the surface temperature of the heated calender rollers is kept constant, the glaze finish will vary over the length of the paper web. A similar phenomenon, although not as severe, occurs in the direction perpendicular to the paper web. Occasionally, different finishing effects occur along the web's edges which cool more rapidly than the center section and have to be rectified by other methods.

SUMMARY OF THE INVENTION

Accordingly, it is an object of the present invention to provide a method and apparatus for processing a web of material having a uniform processing result.

This is accomplished by exposing the web of material on the roll to a preselected temperature environment for a predetermined length of time prior to unrolling it.

The temperature environment may be selected to prevent the web of material from cooling off, i.e. the uneven temperature distribution within the roll is reversed or cancelled out. In this manner, the roller gap system will receive a web of material whose temperature, for all practical purposes, does not change or only to a minimal extent, far below that traditionally encountered. With all other parameters remaining the same, this approach assures a substantially more uniform processing of the web of material in the roller gap over the entire length of tinrolled paper. This in turn makes it possible to also obtain more uniform results in subsequent processes, for example, during printing.

Compared to the normal, ambient environment, the preselected atmospheric environment should preferably have a higher temperature and/or humidity level. The atmospheric temperature can be set such that the roll has the desired gap temperature, or it can be set to where the material's temperature corresponds to the desired level at the output of the production machine, for example, the paper machine. The same applies to the humidity setting. If the roll has already cooled substantially, the atmospheric temperature can be raised somewhat to accelerate the heating process throughout the roll.

Preferably, the temperature and/or humidity of the atmospheric environment is such that it corresponds essentially to the temperature and/or moisture inside of the roll. That temperature can be determined for example by means of sensors positioned inside of the roll, i.e. on the roll's core. However, as mentioned above, the temperature can also be determined by measuring the web's temperature at the output of the production machine or at another upstream processing machine preceding the finishing process. Both the temperature and humidity correspond to the roll's core temperature. The roll continuously dissipates moisture through its surface, thus producing a moisture gradient for which compensation is possible by suitably adjusting the atmospheric environment.

In this context, it is desirable to rotate the roll in its storage position. This eliminates the possibility of an uneven temperature and/or moisture distribution within the storage area affecting the roll with readings that differ from the average. Rotating the roll will assure uniform warming and/or moistening. This is accomplished by means of a device mentioned above, in that the storage area is located within a chamber or compartment, the atmosphere of which can be controlled within preselected temperature and/or humidity parameters.

Since the storage area is enclosed by a housing, the chamber is limited in size and thus permits easy climate control with relatively low energy consumption. At the same time, there is no negative effect on the ambient working environment in the open area of the processing station. The chamber, however, given its preselected atmosphere, provides a uniform temperature and moisture distribution pattern within the roll.

It is desirable to provide the processing station with a fluid-type heating system having a flow line and a return line, with one of the two lines, especially the return line, connected to a heating chamber preferably by way of a secondary line. As mentioned further above, heated calender rollers are in widespread use for the processing of web material. The heat-carrying liquid does not transfer all of its heat to the calender rollers but returns to its heating device at a still rather high temperature. Part of this residual he, at in the carder liquid is reused to contribute to the heating of the chamber. The heating level can be adjusted by way of the secondary pipeline. Where practical, the amount of fluid flowing through the secondary line can also be adjusted. Preferably, the heating chamber has a fan which forces the air past the heating unit and assures a quick, highly uniform temperature distribution within the chamber.

It is particularly desirable to provide a humidifier in conjunction with the chamber heating system. Raising the temperature in the chamber tends to lower the relative humidity which poses the danger of drying out the outer surface of the roll to an undesirable extent. One purpose of the humidifier is to counteract that effect. It is also possible, however, to have the same humidifier provide the necessary moisture to the roll that will permeate from the outside to the inside and restore a greater level of uniformity of the moisture within the roll.

The chamber should also have at least one closure-equipped opening. The opening(s) will permit the loading and removal of the roll. The closures serve to close off the openings so as to maintain the desired atmospheric environment in the chamber. Thus, the energy loss is relatively small. Also, setting a uniform atmospheric environment, including the temperature, is considerably simplified by eliminating outside interference.

A preferred type of closure for one opening is a movable curtain which gives way to the roll. As the roll passes through the opening, it pushes the curtain out of the way, thus providing access to the opening. Once the roll has passed through the opening, the curtain returns to its original position and seals the opening by gravity alone. As an alternative, the opening can be provided with a rolling door or shutter. The rolling shutter requires a mechanical drive and seals the opening more dependably.

It is also desirable to design the roll magazine to incorporate, in front of the chamber, at least one more storage position from which the web rolls are loaded into the magazine. Moving the rolls once they are inside the roll magazine is generally easier than loading them into the magazine. Moving the roll from there into the chamber takes less time than transporting it directly from the outside into the chamber. Also, the chamber opening, through which the roll is loaded, needs to be held open for a shorter length of time which minimizes the energy loss.

Transporting the roll into the chamber is preferably done in essentially horizontal fashion. Of course, deviations from a precisely horizontal axis are possible. However, the horizontal movement has the advantage that the openings may extend along an essentially vertical plane which, when the chamber is opened, helps to minimize heat loss through convection or escaping air.

It is desirable to design the roll magazine with an inclined storage ramp extending through the chamber and with hold-down devices, at least for the storage position within the chamber and possibly directly in front of the chamber as well. The movement of the roll into and, if applicable, out of the chamber, is a matter of gravity in that the roll rolls down a sloped plane. This results in relatively short roll loading times. Inside the chamber, the roll is held in place by the hold-down device. The hold-down device in the storage position, directly in front of the chamber, serves to prevent the on-deck roll from leaning against, and interfering with, the movement of the closure mechanism of the chamber opening.

It is also desirable to equip the storage position in the chamber, and perhaps the storage position directly in front of the chamber, with a roll accelerating device which serves to speed up the loading and unloading of the chamber. This will shorten the time during which the closures must be kept open while lengthening the time that the roll can stay in the chamber. This in turn maximizes the duration of the exposure of the roll to the atmospheric environment inside the chamber.

Preferably, the processing station is housed in an enclosure with a conduit connecting the inside of the enclosure with the inside of the chamber and/or the chamber heating system. This makes it possible to create identical environmental conditions in the processing station and the chamber. If the processing station incorporates a heatable roller or other type of heated component, as is often the case, the heat carried off can be channeled to the chamber, not only by way of the return duct but directly by the surrounding atmosphere. This will again result in considerable energy savings.

BRIEF DESCRIPTION OF THE DRAWINGS

The Single FIGURE is a schematic illustration of the preferred apparatus for processing rolls of web material according to the present invention.

DETAILED DESCRIPTION OF THE INVENTION

Referring to the Single FIGURE, a system 1 for the processing of a roll 2 of a web of material 3 includes a calender 4 in a processing station 5. The calender 4 includes two roller stacks 6, 7, each having three rollers. Each roller stack 6, 7 thus forms two roller gaps. The center roller 8, 9 of each roller stack 6, 7 is heated. As shown by a flow line, each heated roller 8, 9 receives a liquid heating medium which exits by way of a return conduit or pipeline 10. The web of material 3 passes through the calender 4 such that each side of the material 3 comes into contact with one of the heated rollers 8, 9.

Upstream from the processing station 5, i.e. preceding it on the input side, an unrolling station 11 dispenses the web of material 3 from the roll 2 in the direction of the arrow 12. The unrolling station 11 incorporates a conventional handling device 13 for manipulating the roll cores 14 which form the center of each roll 2.

Preceding the unrolling station 11 is a roll magazine 15 incorporating several storage positions 16, 17, 18. These storage positions are mounted on a sloped track 19 which support the rolls 2 with their stub shafts. Gravity allows the rolls 2 to travel on the track 19 in the direction of the unrolling station 11. The slope of the track 19 is relatively flat so that the rolls move along a nearly horizontal plane. Appropriate hold-down and accelerating devices 20, shown schematically, are provided at least for the last and the next-to-last storage position 18, 17 in the roll magazine 15 for stopping and accelerating the rolls 2 in and out of the individual storage positions.

The last storage position 18 in the roll magazine 15, next to the unrolling station 11, is housed in an enclosure 21 which includes a chamber 22. The enclosure 21 is provided with a feed opening 24 having a rolling shutter-type closure 23, as well as a discharge opening 26 with a rolling shutter-type closure 25. In place of the shutters 23, 25, other types of closures can be used for the openings 24, 26, for instance curtains which, unlike the shutters 23, 25, do not require a drive mechanism but can be pushed aside by the roll 2 itself. The chamber 22 can be climate-controlled, meaning that both the temperature and the humidity of the air or atmosphere in the chamber 22 can be set to preselected values. Under certain circumstances, humidity control may not be necessary.

A heating system 27 provides the necessary temperature control. The heating system 27 includes part of the return conduit 10 from the heated rollers 8, 9 which in the form of a secondary conduit winds through the chamber 22. The amount of heat-carrying liquid fed to the chamber 22 is controlled by a valve 29. By means of a control device not illustrated, the valve 29 can be regulated as a function of the temperature in the chamber 22.

The heating system 27 is further equipped with a fan 30 which forces the air past the secondary conduit 28 to heat up the conduit. The fan 30 also provides an even distribution of the heated air in the chamber 22, so that the roll 2 is uniformly exposed on all sides to the heated air. The system also incorporates a humidifier 31 which channels the air stream from the fan 30 and controls the relative humidity in the chamber 22.

The processing station 5 is housed in an enclosure 32 which has an access opening 33 and an exit opening 34 for the web of material 3, both of which must remain open at all times. There are also closure-equipped openings 35, 36 which are large enough to allow the exchange of the rollers of the roller stacks 6, 7 by means of a crane 37 (as outlined) or by other suitable means. The openings 35, 36 are closed by means of shutters 38, 39, which alternately may include sliding, folding, drop or other types of doors. The type of access is not critical since the rollers of the roller stacks 6, 7 are not replaced as often as the rolls 2 in the dispensing or unrolling station 11.

The enclosure 32 is provided with thermal insulation to restrict the heat radiated by the heated rollers 8, 9. The rollers 8, 9 operate consistently at input levels in the range of 20 kW per meter of roller length. The energy consumption and associated energy loss of the rollers 8, 9 are correspondingly high. Encapsulating the rollers 8, 9 in the enclosure 32 permits a drastic reduction of these losses. If the calender 4 is not operated on-line as illustrated, but instead, in an in-line arrangement, the enclosure 32 may be in the form of an extension of the system's preceding dryer section.

The enclosure 32 also has a steam generating device 40. By way of three injection nozzles 41, 42, 43, steam is blown into the enclosure 32 by the device 40. Thus, the housing 32 also functions as an oversized steam-type humidifier. The web of material 3 passing through the enclosure 32 is now exposed not only to the pressure and temperature in the roller gaps of the roller stacks 6 and 7 but also to the correspondingly higher temperature and humidity of the atmosphere within the enclosure 32. The moisture level of the web of material 3 can be measured by means of a sensor 44 which is connected with and controls the steam generating device 40. This produces a closed control loop for controlling the moisture of the web of material. If desired, a feed system 46 may be installed by way of a duct 45, wherein the enclosure 32 is connected with the chamber 22 and the duct 45 permits the feeding of the atmosphere from the processing station 5 into the chamber 22. In this manner, the energy released by the heated rollers 8, 9 can contribute to the heating of the chamber 22. If the steam generating device 40 adequately humidifies the atmosphere in the enclosure 32, that humidity can also be transferred into the chamber 22.

In operation, a roll 2 is deposited in the first storage position 16 of the roll magazine 15, for instance, by means of a crane or a hoist. Each time a roll 2 has been unwound in the unrolling station 11, a process which can easily take from 1 to 2 hours, the roll 2 in the roll magazine 15 advances to the right by one position until it ultimately arrives in the chamber 22. There, the roll is exposed to high temperature and, if appropriate, to high humidity which causes the temperature distribution, that became uneven during the storage in the roll magazine 15, to become uniform again. This means that as the roll 2 is unwound in the unrolling station 11, it attains a relatively even temperature over its length and width before it enters the processing station 5. In the processing station 5, the web of material 3 is exposed not only to high pressure and an elevated temperature in the roller gap of the roller stacks 6, 7 but also to high humidity emanating from the steam generating device 40. The humidity or moisture level is controlled with the aid of the sensor 44 and held, for instance, at a level that corresponds to the humidity level found in the environment of a printing operation where the paper is to be imprinted.

While on stand-by in the chamber 22, the roll 2 stored therein may be rotated by a drive unit (not shown). This is beneficial in that the roll 2 will be evenly heated even if the temperature distribution within the chamber 22 is not entirely uniform.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A method of processing a web of material, comprising the steps of:

a) providing a roll having a web of material wound thereabout;

b) exposing said roll, with said web of material wound thereabout, in a roll storage position to a preselected atmospheric environment at least one of the temperature and humidity level higher than that of the normal ambient environment for a predetermined minimum time duration; and c) unwinding said web of material from said roll and feeding said unwound web of material through at least one roller gap of a roller-gap system.

2. The method of claim 1, wherein at least one of the temperature and humidity level of said preselected atmospheric environment essentially corresponds to at least one of the temperature and humidity level inside the roll.

3. The method of claim 1, wherein said unwound roll is rotated in said roll storage position.

4. An apparatus for processing a web of material wound on a roll, said apparatus comprising a processing station, an unrolling station preceding said processing station, and a roll magazine preceding said unrolling station and including at least one roll storage position located in a climate-controlled chamber, wherein said at least one roll storage position is shaped to accommodate a roll having a web of material wound thereabout.

5. The apparatus of claim 4, wherein said processing station has a fluidic heater with a flow pipeline and a return pipeline, at least one of said flow pipeline and said return pipeline being connected to a chamber heating unit by a secondary pipeline.

6. The apparatus of claim 5, wherein said chamber heating unit has a fan.

7. The apparatus of claim 5, wherein said chamber heating unit has an air humidifier.

8. The apparatus of claim 4, wherein said chamber has at least one closure-equipped opening.

9. The apparatus of claim 8, wherein said at least one closure-equipped opening is closed by means of a movable curtain.

10. The apparatus of claim 8, wherein said at least one closure-equipped opening comprises a roller-type shutter for closing said opening.

11. The apparatus of claim 4, wherein said roll magazine has at least one additional storage position in front of said chamber.

12. The apparatus of claim 11, wherein the roll is transported into said chamber along an essentially horizontal plane.

13. The apparatus of claim 4, wherein said roll magazine has an inclined storage surface which extends through said chamber and has hold-down devices for said at least one storage position in said chamber.

14. The apparatus of claim 13, further comprising hold-down devices for at least one storage position directly in front of said chamber.

15. The apparatus of claim 13, wherein said at least one storage position in said chamber is provided with a roll accelerating device.

16. The apparatus of claim 14, wherein said at least one storage position directly in front of said chamber is provided with a roll accelerating device.

17. The apparatus of claim 5, wherein said processing station is housed in an enclosure having a conduit which connects the inside of said enclosure with at least one of the inside of said chamber and said chamber heating unit.

18. The apparatus of claim 4, wherein the atmosphere of said climate-controlled chamber is controlled to at least one of a preselected temperature and humidity level.

19. An apparatus for processing a web of material wound on a roll, said apparatus comprising a processing station, an unrolling station preceding said processing station, and a roll magazine preceding said unrolling station and including at least one roll storage position located in a climate-controlled chamber, wherein said processing station has a fluidic heater with a flow pipeline and a return pipeline, at least one said flow pipeline and return pipeline being connected to a chamber meeting unit by a secondary pipeline.

20. An apparatus for processing a web of material wound on a roll, said apparatus comprising a processing station, an unrolling station preceding said processing station, and a roll magazine preceding said unrolling station and including at least one roll storage position located in a climate-controlled chamber, wherein said roll magazine has an inclined storage surface which extends through said chamber and has hold-down devices for said at least one storage position in said chamber.

* * * * *